US012693046B2

(12) United States Patent
Szutiak et al.

(10) Patent No.: US 12,693,046 B2
(45) Date of Patent: Jul. 28, 2026

(54) METHODS AND SYSTEMS FOR INCREASING HEAT TRANSFER IN GEOTHERMAL SYSTEMS

(71) Applicant: GreenFire Energy Inc., Walnut Creek, CA (US)

(72) Inventors: Greg Szutiak, Calgary (CA); Alan D. Eastman, Holladay, UT (US); John R. Muir, St. George, UT (US)

(73) Assignee: GreenFire Energy Inc., Walnut Creek, CA (US)

( * ) Notice: Subject to any disclaimer, the term of this patent is extended or adjusted under 35 U.S.C. 154(b) by 0 days.

(21) Appl. No.: 19/011,341

(22) Filed: Jan. 6, 2025

(65) Prior Publication Data

US 2025/0224151 A1 Jul. 10, 2025

Related U.S. Application Data

(60) Provisional application No. 63/618,188, filed on Jan. 5, 2024.

(51) Int. Cl.
*F24T 10/30* (2018.01)
*E21B 43/24* (2006.01)
(Continued)

(52) U.S. Cl.
CPC ..... *F24T 10/30* (2018.05); *E21B 43/2405* (2013.01); *E21B 43/267* (2013.01); *F24T 50/00* (2018.05); *F24T 2010/50* (2018.05)

(58) Field of Classification Search
CPC .. E21B 43/267; E21B 43/2405; E21B 43/247; F24T 10/10; F24T 2201/00; F24T 50/00; F24T 10/17; F24T 2010/50; F24T 2010/53; F24T 10/20; F24T 10/15; F24T 10/30
See application file for complete search history.

(56) References Cited

U.S. PATENT DOCUMENTS

2022/0341631 A1 10/2022 Alharbi et al.
2023/0235208 A1 7/2023 Evans et al.

FOREIGN PATENT DOCUMENTS

CA 2676086 A1 * 9/2008 ..... E21B 36/04
CA 3230116 A1 3/2023
(Continued)

OTHER PUBLICATIONS

International Search Report and Written Opinion issued in Application No. PCT/US2025/010492, mailed on Mar. 26, 2025 (23 pages).

*Primary Examiner* — Zakiya W Bates
(74) *Attorney, Agent, or Firm* — Osha Bergman Watanabe & Burton LLP

(57) ABSTRACT

A slurry configured to promote the transfer of heat, systems employing the slurry, and a method of using the systems and slurry are provided. The slurry may include a quantity of a thermally conductive material configured to transfer heat. The slurry may also include a quantity of a proppant configured to prop open one or more fractures. The slurry may further include a quantity of a slurrying agent configured to suspend the quantity of the thermally conductive material within the quantity of the slurrying agent. The slurry is configured to preserve permeability within one or more fractures and facilitate a transfer of heat.

22 Claims, 10 Drawing Sheets

(51) Int. Cl.

| | |
|---|---|
| ***E21B 43/267*** | (2006.01) |
| ***F24T 10/00*** | (2018.01) |
| ***F24T 50/00*** | (2018.01) |

(56) References Cited

FOREIGN PATENT DOCUMENTS

| | | | | | |
|---|---|---|---|---|---|
| CA | 3235333 | A1 * | 4/2023 | ..... | F24T 10/17 |
| WO | 2023034425 | A1 | 3/2023 | | |
| WO | 2023150466 | A1 | 7/2023 | | |

* cited by examiner

METHODS AND SYSTEMS FOR INCREASING HEAT TRANSFER IN GEOTHERMAL SYSTEMS

BACKGROUND

Geothermal production systems extract heat from the subsurface. This enables geothermal systems to produce power at any time during the day or night unlike other renewable energy sources such as wind and solar. However, the problem with geothermal systems is extracting enough heat from the subsurface to ensure the system produces the requisite amount of energy. The surface area of the interface between a heat collector and hot rock is the main driving factor involved in heat transfer and the efficiency of heat transfer from the subsurface to the geothermal production system.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In some aspects, the techniques described herein relate to a slurry for heat transfer between a subsurface and a downhole heat exchanger inserted in a wellbore. The slurry includes a quantity of a thermally conductive material, a quantity of a proppant, and a quantity of a slurrying agent. The thermally conductive material is configured to transfer heat. The quantity of a proppant is configured to prop open one or more fractures. The quantity of a slurrying agent is configured to suspend the quantity of the thermally conductive material within the quantity of the slurrying agent. The slurry is configured to preserve permeability within one or more fractures and facilitate a transfer of heat.

In some aspects, the techniques described herein relate to a method for heat transfer between a subsurface and a downhole heat exchanger inserted in a wellbore. The method includes pumping a first volume of a slurry into the wellbore and into one or more fractures. The first volume of the slurry includes a quantity of a thermally conductive material configured to transfer heat, a quantity of a proppant configured to prop open one or more fractures, and a quantity of a slurrying agent configured to suspend the quantity of the thermally conductive material within the quantity of the slurrying agent. The first volume of the slurry is configured to preserve permeability within the one or more fractures and facilitate a transfer of heat. The method includes inserting a closed-loop geothermal system into the wellbore to form an augmented closed-loop geothermal system. The augmented closed-loop geothermal system includes a fluid conduit, and the downhole heat exchanger fluidly connected to the fluid conduit.

In some aspects, the techniques described herein relate to a system of increasing heat transfer between a downhole heat exchanger and a subsurface. The system includes a wellbore extending from a surface and penetrating the subsurface, a slurry pumping system configured to pump a first volume of slurry into one or more fractures, a closed-loop geothermal system, and a completions system. The first volume of slurry includes a quantity of a thermally conductive material configured to transfer heat, a quantity of a proppant configured to prop open the one or more fractures, and a quantity of a slurrying agent configured to suspend the quantity of the thermally conductive material within the quantity of the slurrying agent. The first volume of the slurry is configured to preserve permeability within the one or more fractures and facilitate a transfer of heat. The closed-loop geothermal system is configured to transfer heat from the downhole heat exchanger to an uphole heat exchanger. The closed-loop geothermal system includes a working fluid configured to transfer heat, the uphole heat exchanger configured to transfer heat from the working fluid, the downhole heat exchanger disposed within the wellbore and configured to transfer heat to the working fluid, and a fluid conduit fluidly connected to the uphole heat exchanger and the downhole heat exchanger. The fluid conduit includes a closed-loop flow path and is configured to transport the working fluid between the uphole heat exchanger and the downhole heat exchanger. The completions system is configured to insert the downhole heat exchanger and the fluid conduit into the wellbore to form an augmented closed-loop geothermal system with the slurry.

In some aspects, the techniques described herein relate to a system of increasing heat transfer between a subsurface and a downhole heat exchanger during operation. The system includes a wellbore extending from a surface and penetrating the subsurface, a closed-loop geothermal system configured to transfer heat from the downhole heat exchanger to an uphole heat exchanger, one or more fractures within the subsurface and filled, at least partially, with a proppant and thermally conductive material sufficient to form a thermally conductive pathway, and a heat utilization system. The closed-loop geothermal system includes a working fluid configured to transfer heat, the uphole heat exchanger, the downhole heat exchanger, and a fluid conduit. The uphole heat exchanger is configured to transfer heat from the working fluid. The downhole heat exchanger is disposed within the wellbore and configured to transfer heat to the working fluid. The fluid conduit is fluidly connected to the uphole heat exchanger and the downhole heat exchanger. The fluid conduit includes a closed-loop flow path and configured to transport the working fluid between the uphole heat exchanger and the downhole heat exchanger. The thermally conductive pathway is configured to transfer heat from the subsurface to the downhole heat exchanger forming an augmented closed-loop geothermal system. The heat utilization facility is configured to operate the downhole heat exchanger and includes an uphole heat exchanger configured to extract heat energy from the hot working fluid, and a turbine operatively connected to the fluid conduit and configured to generate electrical power. The turbine is operatively connected to the uphole heat exchanger.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
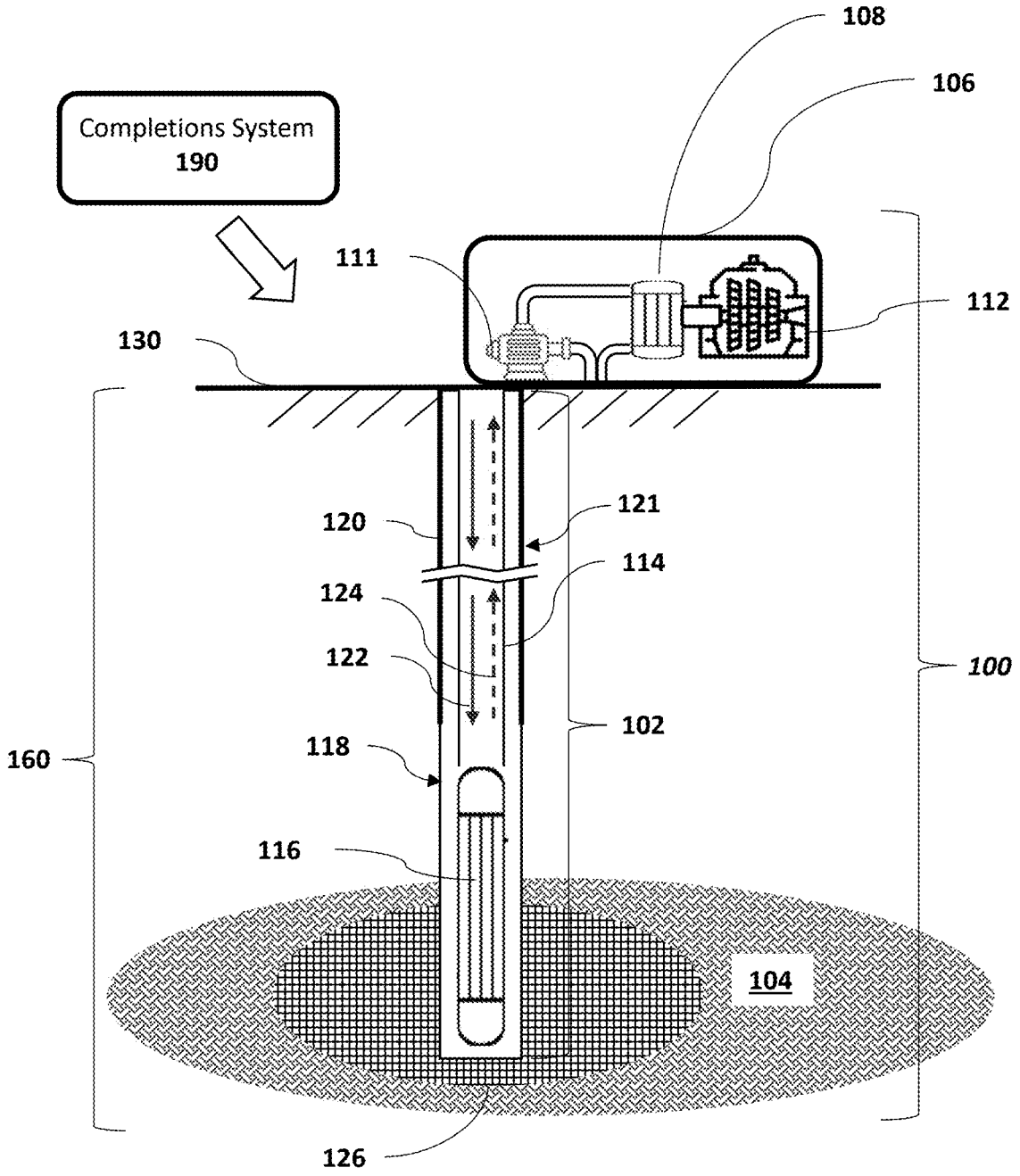
FIG. 1 depicts a geothermal system in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

It is to be understood that the singular forms "a," "an," and "the" include plural referents unless the context clearly dictates otherwise. Thus, for example, reference to "a fluid sample" includes reference to one or more of such samples.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that one or more of the steps shown in the flowchart may be omitted, repeated, and/or performed in a different order than the order shown. Accordingly, the scope disclosed herein should not be considered limited to the specific arrangement of steps shown in the flowchart.

Although multiple dependent claims are not introduced, it would be apparent to one of ordinary skill that the subject matter of the dependent claims of one or more embodiments may be combined with other dependent claims.

In the following description of FIGS. 1-9, any component described with regard to a figure, in various embodiments disclosed herein, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments disclosed herein, any description of the components of a figure is to be interpreted as an optional embodiment which may be implemented in addition to, in conjunction with, or in place of the embodiments described with regard to a corresponding like-named component in any other figure.

Systems, methods, and composition of matter are disclosed herein for augmenting a closed-loop geothermal system for an increase in heat transfer from a portion of a subsurface to an augmented closed-loop geothermal system. The augmented closed-loop geothermal system includes a slurry having at least a quantity of thermally conductive material, a quantity of proppant, and a quantity of slurrying agent. The slurry is configured to be pumped into one or more of the naturally occurring or created subsurface fractures thereby preserving permeability and to thermally conduct heat from a portion of the subsurface to the augmented closed-loop geothermal system at an increased efficiency relative to typical proppant and geothermal systems. The slurry, or at least a portion of the proppant and the thermally conductive material after the slurry has settled, is also configured to preserve permeability even when the pressure is relieved after stimulation operations.

FIG. 1 depicts a closed-loop geothermal system (100) that may be used in a system of increasing heat transfer between a downhole heat exchanger and a subsurface (hereafter "heat transfer system"). The closed-loop geothermal system (100) includes a wellbore (102) extending from a surface, such as surface of the earth (130), to a geothermal heat source (104) and penetrating into a subterranean region of interest (hereafter "subsurface") (160). Typically, the geothermal heat source (104) will be one or more rock formations characterized by an elevated temperature that may lie at intervals to a depth of several thousand feet below the surface of the earth (130). Often the rock formation may be a volcanic pluton, solidified from molten lava injected by volcanic or tectonic forces between the surrounding rock formations, and have a low fluid permeability. The wellbore (102) may be substantially vertical, as shown, or may be significantly deviated. The wellbore (102) may also have horizontal portions, or even have portions that become shallower with increasing distance along the wellbore (102).

Portions of a wellbore may be cased, typically with steel pipe, to form "cased hole" portions such as cased hole portion (121). Typically, at least the shallowest portions of the wellbore (102) may be cased to provide mechanical stability to the wellbore and/or to isolate near-surface ground water, including drinking water aquifers from fluid originating at deeper depths and/or the drilling fluids used to create the wellbore (102). Often a casing string (120) will be cemented into place, using an annular sheath of cement between the exterior surface of the casing string (120) and the rock wall of the wellbore. In some cases, multiple sets of casing (not shown) may be present, disposed within one another and substantially sharing a common axis. Other portions of the wellbore (102) may be left uncased to create "openhole" portions (118) of the wellbore (102). While a casing string essentially isolates the interior of the cased hole portion (121) from the formation fluids in the surrounding rock formation and provides additional thermal insulation in the form of one or more layers of steel and cement, openhole portions (118) permit fluid, including hot fluid, and heat to flow more easily into and out of the openhole portion (118).

At, near, or above the surface of the earth (130) the wellbore (102) may connect to a heat utilization facility (106). The heat utilization facility (106) may include, without limitation, one or more heat exchangers, such as an uphole heat exchanger (108) to extract heat energy from the hot working fluid (124), and/or one or more turbines, such as turbine (112) to generate electrical power. The uphole turbine(s) may be connected to the uphole heat exchanger(s) or connected directly to the tubulars carrying the hot working fluid (124) uphole.

In accordance with one or more embodiments, a downhole heat exchanger (116) may be deployed within the wellbore (102). The downhole heat exchanger (116) may function to heat a cool working fluid (122) supplied to it by transferring heat (646) from hot geothermal fluid surrounding the downhole heat exchanger (116) and producing hot working fluid (124). Tubulars (pipes), such as fluid conduits (114), must fluidically connect the downhole heat exchanger (116) with the heat utilization facility (106) on the surface of the earth (130), and particularly with the uphole heat exchanger (108), allowing cool working fluid (122) to flow, or to be pumped, for example by uphole pump (111), downhole, and hot working fluid (124) to flow uphole. The tubulars must be configured to allow cool working fluid (122) to flow in one direction and hot working fluid (124) to flow in the opposite direction without mixing with one another. This is generally accomplished by insulating the tubulars or placing an insulated material between them. Examples of designs for fluid conduits are shown below in FIGS. 4A-4D.

Cool working fluid (122) may extract heat, for example using the downhole heat exchanger (116), from the geothermal heat source (104), i.e., the hot rock formation. However, particularly in low permeability rocks the extraction of heat will cool the rock formation in a region surrounding the downhole heat exchanger (116), causing the temperature of this restricted zone (126) surrounding the downhole heat exchanger (116) to cool. Since many rocks are poor conductors of heat, and in low permeability rocks hot fluids cannot easily percolate into the restricted zone (126), the extracted heat cannot be easily replaced from more distant portions of the geothermal heat source (104) and the efficacy of the geothermal system may decrease over time. However, embodiments herein having improved thermal conductivity pathways and with careful regulation of flow, the systems herein can reach a point of near equilibrium where the decline in power generation will be very slow over the lifecycle of the well.

In some embodiments of the closed-loop geothermal system (100), a pre-existing wellbore may be used. For example, a wellbore previously drilled to provide fresh water, for geotechnical purposes, for geothermal purposes, or extended for the heat transfer system. In other embodiments, a wellbore such as the wellbore (102) may be drilled specifically for the construction of the heat transfer system disclosed herein using a drilling system, such as drilling system (200) described in relation to FIG. 2. Based on the disclosure herein, it will be apparent to those skilled in the art that there are various configurations of a closed-loop geothermal system that may be used in the heat transfer system and the closed-loop geothermal system depicted in FIG. 1 should not be considered limiting to the disclosed and claimed invention.

In some embodiments, a completions system (190) may be used to insert the downhole heat exchanger (116) and the fluid conduit (114) into the wellbore (102). The completions system (190) may include a rig configured to insert the downhole heat exchanger (116) and tubulars, such as the casing string (120) and the fluid conduit (114), into the wellbore (102). In some embodiments, the completions system (190) may include a specialized tubular insertion rig configured to handle the downhole heat exchanger (116), the fluid conduit (114) and/or the casing string (120) with greater precision and gentler handling than a typical rig so as not to damage any outer surface of tubulars, such as the casing string (120) and/or the fluid conduit (114), and provide improved connections between individual tubular sections.

While FIG. 1 shows various configurations of components, other configurations may be used without departing from the scope of the disclosure. For example, various components in FIG. 1 may be combined to create a single component. As another example, the functionality performed by a single component may be performed by two or more components.

Figure 2:
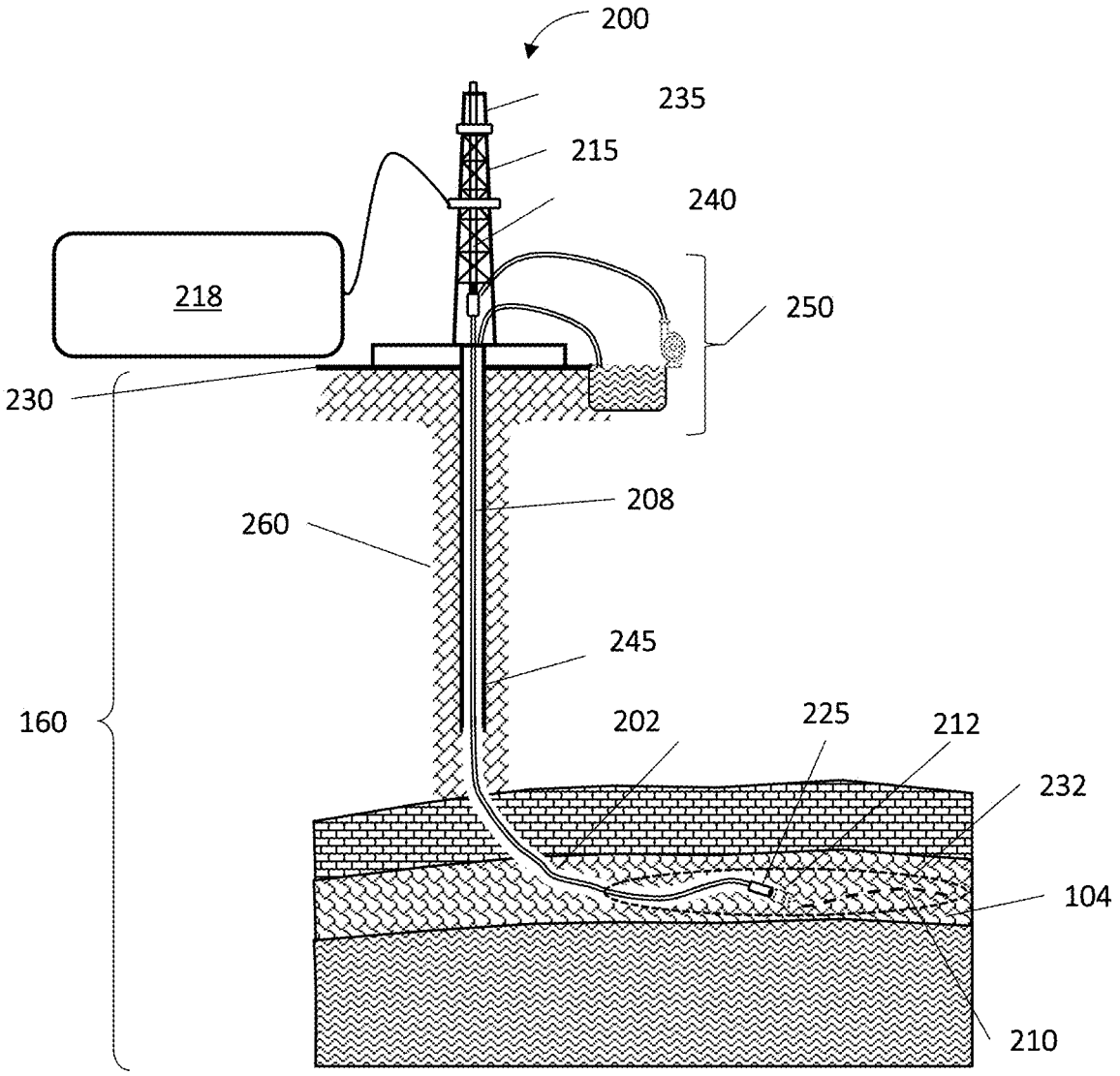
FIG. 2 depicts a drilling system that may be used in various embodiments.

FIG. 2 illustrates a drilling system (200) in accordance with one or more embodiments. In some embodiments, the drilling system (200) may be configured to drill a wellbore, such as wellbore (202) within a subterranean region of interest such as subsurface (160) guided by a wellbore drilling plan, that may include a planned wellbore path (210). In some embodiments, the wellbore drilling plan may be designed such that the planned wellbore path (210) penetrates the location of a geothermal heat source (104) within the subsurface (160). The planned wellbore path (210), and the resulting wellbore (202) may include substantially vertical portions, deviated and highly deviated portions, and horizontal portions, without departing from the scope of the invention. The wellbore (202) may be drilled in order to receive the closed-loop geothermal system (100).

Although the drilling system (200) shown in FIG. 2 is depicted as drilling the wellbore (202) on land, the drilling system (200) may be a marine wellbore drilling system, including a jack-up rig, floating rig, semi-submersible rig, or drill-ship, without departing from the scope of the invention. Further, although the drilling system (200) shown in FIG. 2 is depicted as drilling the wellbore (202), the wellbore being drilled may be a sidetrack wellbore (not shown). As such, the example of the drilling system (200) shown in FIG. 2 is not meant to limit the disclosed and claimed invention.

As shown in FIG. 2, the drill rig may be equipped with a hoisting system, such as a derrick (215), which can raise or lower a drillstring (208) and other tools required to drill the wellbore (202). The drillstring (208) may include one or more drill pipes connected to form conduit and a bottom hole assembly (225) (BHA) disposed at the distal end of the drillstring (208). The BHA (225) may include a drill bit (212) to cut into rock (260). The BHA (225) may further include measurement tools, such as a measurement-while-drilling (MWD) tool and logging-while-drilling (LWD) tool. MWD tools may include sensors and hardware to measure downhole drilling parameters, such as the azimuth and inclination of the drill bit (212), the weight-on-bit, and the torque. The LWD measurements may include sensors, such as resistivity, gamma ray, and neutron density sensors, to characterize the rock (260) surrounding the wellbore (202). Both MWD and LWD measurements may be transmitted to a surface of the earth (230) using any suitable telemetry system known in the art, such as a mud-pulse or by wired-drill pipe.

To start drilling, or "spudding in," the wellbore (202), the hoisting system lowers the drillstring (208) suspended from the derrick (215) of the drill rig towards the planned surface location of the wellbore (202). An engine, such as a diesel engine, may be used to supply power to a top drive (235) to rotate the drillstring (208) via a drive shaft (240). The weight of the drillstring (208) combined with the rotational motion enables the drill bit (212) to bore the wellbore (202).

The near-surface rock of the subsurface (160) is typically made up of loose or soft sediment or rock, so large diameter casing (245) (e.g., "base pipe" or "conductor casing") is often put in place while drilling to stabilize and isolate the near-surface wellbore. At the top of the base pipe is the wellhead (not shown), which serves to provide pressure control through a series of spools, valves, or adapters. Once near-surface drilling has begun, water or drill fluid may be used to force the base pipe into place using a pumping system until the wellhead is situated just above the surface of the earth (230).

Drilling may continue without any casing (245) once deeper or more compact rock (260) is reached. While drilling, a drilling mud system (250) may pump drilling mud from a mud tank on the surface of the earth (230) through the drill pipe. Drilling mud serves various purposes, including pressure equalization, removal of rock cuttings, and drill bit cooling and lubrication.

At planned depth intervals, drilling may be paused and the drillstring (208) withdrawn from the wellbore (202). Sections of casing (245) may be connected, inserted, and cemented into the wellbore (202). Casing string may be cemented in place by pumping cement and mud, separated by a "cementing plug," from the surface of the earth (230) through the drill pipe. The cementing plug and drilling mud force the cement through the drill pipe and into the annular space between the casing (245) and the wall of the wellbore (202). Once the cement cures, drilling may recommence. The drilling process is often performed in several stages. Therefore, the drilling and casing cycle may be repeated more than once, depending on the depth of the wellbore (202) and the pressure on the walls of the wellbore (202) from surrounding rock (260).

Due to the high pressures experienced by deep wellbores, a blowout preventer (BOP) may be installed at the wellhead to protect the rig and environment from unplanned oil or gas releases. As the wellbore (202) becomes deeper, both successively smaller drill bits (212) and casing (245) may be used. Drilling deviated or horizontal wellbores may require specialized drill bits (212) or drill assemblies.

The drilling system (200) may be disposed at and communicate with other systems in the wellbore environment, such as the wellbore planning system (218). The drilling system (200) may control at least a portion of a drilling operation by providing controls to various components of the drilling operation. In one or more embodiments, the drilling system (200) may receive data from one or more sensors arranged to measure controllable parameters of the drilling operation. As a non-limiting example, sensors may be arranged to measure weight-on-bit, drill rotational speed (RPM), flow rate of the mud pumps (GPM), and rate of penetration of the drilling operation (ROP). Each sensor may be positioned or configured to measure a desired physical stimulus. Drilling may be considered complete when a drilling target (232) within the geothermal heat source (104) is reached.

The direction of a wellbore may be controlled by both active and passive directional drilling (or steering). In passive directional drilling the well trajectory is determined by the flexing or buckling of the drillstring (208) in response to the application of greater or lesser weight-on-bit and the design of the BHA (225). A conventional BHA equipped with multi-stabilizers may be used to control the hole deviation angle based on the lever principle or pendulum effect. However, the resulting wellbore path is also influenced by the natural features of strength or weakness of the rock formation and so the precision with which the wellbore trajectory can be controlled may be limited.

Active directional drilling may be performed using a variety of specialized BHA and drill bits known in the art. For example, BHA components known as "bent-subs" may hold the drill bit at a fixed orientation of a few degrees of deviation (typically, 1 or 2 degrees of angle) to the axis of the BHA. When the drillstring (208) is rotated the drill bit bores a portion of the wellbore in a direction parallel to the axis of the BHA. In contrast, when the drillstring (208) is unrotated but the drill bit rotated by a motor (e.g., a mud-motor or an electrical motor) then the wellbore is extended in the direction of orientation and the rate of deviation of the drill bit. Alternatively, wellbores may be deviated using rotatory steerable devices (RSD) that use continuously adjusted pressure pads on the BHA to push or point the drill bit, and hence the resulting wellbore, in the desired direction. Since RSDs work with the drillstring continuously rotating they are often preferred over bent-subs because of their superior drillstring drag-reduction and hole cleaning characteristics.

Figure 3:
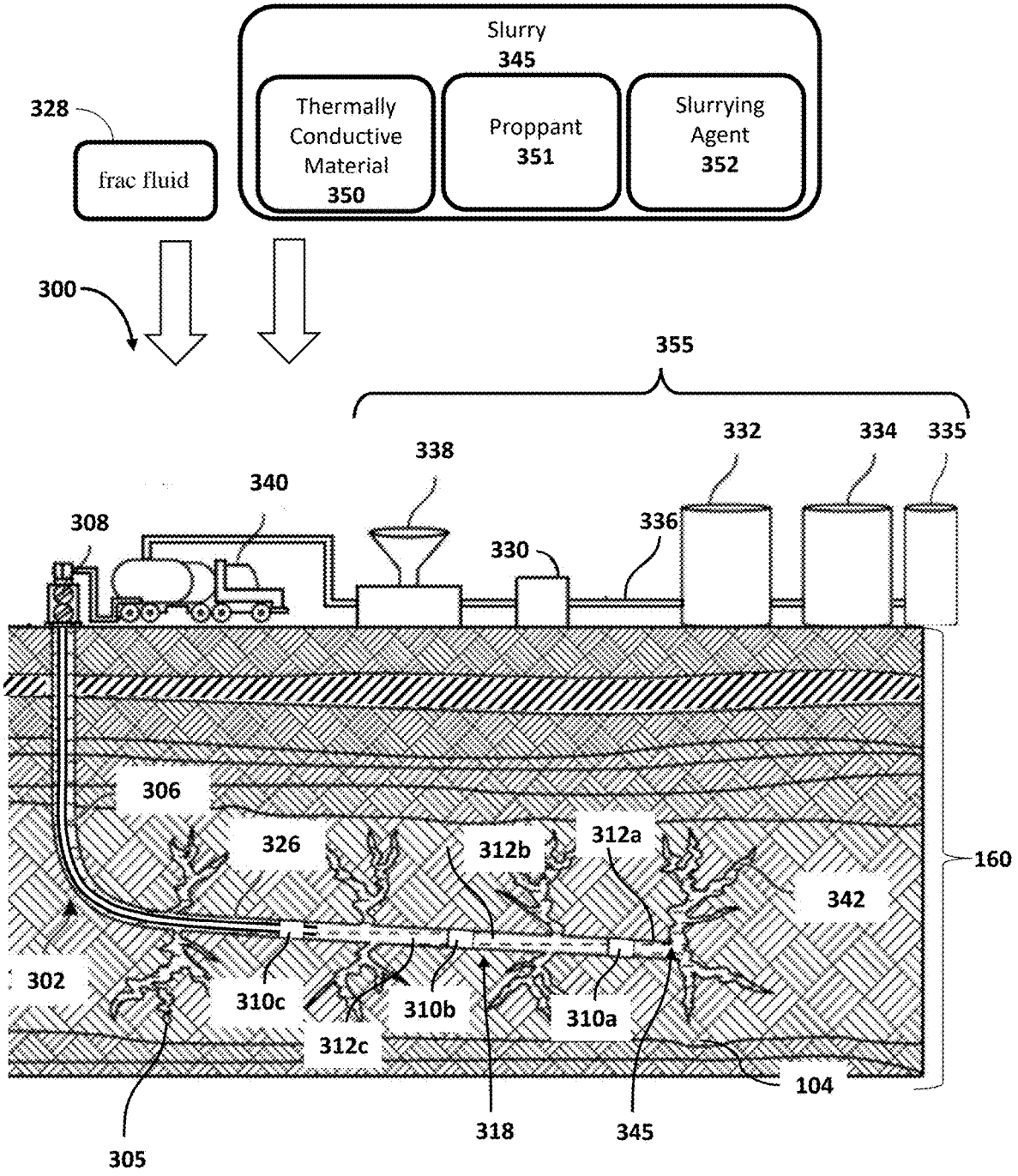
FIG. 3 depicts a stimulation system that may be used in stimulating a portion of a subsurface in accordance with one or more embodiments.

FIG. 3 illustrates a stimulation system, specifically a hydraulic fracturing system (300) performing a hydraulic fracturing operation in accordance with one or more embodiments. The hydraulic fracturing system (300) and hydraulic fracturing operation are for illustration purposes only. The scope of the disclosure is intended to encompass any type of hydraulic fracturing system and hydraulic fracturing operation. However, the hydraulic fracturing system used in embodiments may often be a small scale, "slimmed-down," or minimal system, as will be described below. This has the advantage of reducing unnecessary cost, time, and environmental impact.

In some embodiments, the hydraulic fracturing operation is performed by separating a wellbore such as wellbore (302) into multiple wellbore lengths separated by packers (310*a-c*) that hydraulically isolate the intervening lengths, sometimes termed "stages", e.g., stages (312*a-c*). Each stage may be connected by tubing (306) to a set of valves attached to the wellhead at the surface, sometimes termed a "frac tree" (308). In some embodiments, a first packer (310*a*) may be installed near the toe of the wellbore (302) to form a first stage (312*a*) that may be fractured. Then a second packer (310*b*) may be installed to form a second stage (312*b*) between the first packer (310*a*) and the second packer (310*b*) that may be fractured. Similarly, additional packers, e.g., packer (310*c*), may be installed sequentially one at a time to form additional stages, e.g., stage (312*c*) that may be fractured prior to the installation of the next pack in the sequential series. In other embodiments, a plurality of packers (310*a-c*) may be installed first with each stage connected to the tubing (306) from the frac tree (308) before isolating and fracturing each stage (312*a-c*) sequentially using valves (not shown) within the tubing (306). Typically, the tubing (306) and all the packers (310*a-c*) are removed from the well after the hydraulic fracturing is completed. In general, a single wellbore may have anywhere from one to more than forty stages, however for the embodiments described herein typically only a small number of stages are contemplated. For example, a lower stage (closest to the toe of the wellbore (302) within a geothermal heat source such as geothermal heat source (104)), and intermediate stage (near the middle of the wellbore (302) within the geothermal heat source (104)), and an upper stage (near the beginning of the wellbore (302) within the geothermal heat source (104)). Often this small number of stages and stimulations will be adequate to provide the necessary permeability channels.

In an openhole portion, such as openhole portion (318), of the wellbore (302), hydraulic fracturing of each stage may include a pumping operation where high-pressure fluid is pumped into the stage until the surrounding rock fractures. In cased-hole portions each stage may also include a perforation operation where holes are formed through the casing, often with the aid of explosive charges, such as focused explosive charges.

The frac tree (308) is similar to a production tree but is specifically installed for the hydraulic fracturing operation. The frac tree (308) tends to have larger bores and higher-pressure ratings than a production tree. Further, hydraulic fracturing operations frequently require abrasive materials being pumped into the wellbore, such as the wellbore (302), at high pressures, so the frac tree (308) is designed and constructed from materials better able to handle a higher rate of erosion.

FIG. 3 further shows a slurry mixing system (355) in accordance with one or more embodiments. The slurry mixing system (355) may include one or more storage containers such as additives storage containers (330), slurrying agent storage containers (332), proppant storage containers (334), and thermally conductive material storage containers (335) that are constituents of the hydraulic fracturing system (300). In some embodiments disclosed herein, proppants and hence proppant storage containers (334) are not necessary, and the proppant storage containers (334) may be omitted, however in other embodiments proppant may be used and the proppant storage containers (334) required. Frac lines (336) and transport belts (not pictured) transport the additives, proppant, and water from the storage containers (330), (332), (334), (335) into a mixer such as a frac blender (338). Sensors (not pictured) may be located throughout this equipment to send signals to a monitoring system. The monitoring system may be used to control the volume of slurrying agent, additives, proppant, and/or thermal conductive material used in the pumping operation.

The frac blender (338) blends slurrying agents, such as slurrying agent, additives, proppant, and/or thermally conductive material to form a slurry (345) that may be configured to stimulate the subsurface, prop open one or more fractures, and/or facilitate the transfer of heat between a downhole heat exchanger and a subsurface. In some embodiments, the proppant may not be added with the thermally conductive material. The slurry may be mixed, using a mixer such as the frac blender (338), with the slurrying agent, such as water, and/or additives to form a volume of a frac fluid (328).

In some embodiments, the slurry (345) may be pumped through a channel, such as frac lines, to a slurry pumping system (340) that may include one or more frac pumps, often pump trucks, to be pumped through the frac tree (308) into the wellbore. The slurry pumping system (340) includes a pump designed to pump the slurry (345) at a certain pressure. More than one pump truck may be used at a time to increase the pressure by combining the output slurry (345) and/or frac fluid of each pump truck in a "frac manifold" before being pumped through casing (326) into the wellbore (302). The slurry (345) is transported from the frac manifold to the frac tree (308) using frac lines (336). In some embodiments, the frac fluid (328) having slurrying agent, proppant, and/or additives may be pumped separately from the slurry (345) having slurrying agent, thermally conductive material, and/or additives. The frac fluid (328) may be pumped before or after the slurry (345) has been pumped and injected into one or more fractures within the subsurface (160).

In some embodiments, the thermally conductive material (350) in the form of solid granules may be mixed at the surface with the proppant (351) and the slurrying agent (352), such as formation brine, to form the slurry (345) and a volume of the slurry is pumped through the channel, e.g., coiled tubing, into the wellbore (302), where a volume of the slurry (345) may be injected into one or more fractures or settle in an annulus formed between casing and the closed-loop geothermal system (100). The slurry pumping system (340) may be configured to pump a volume of the slurry (345) into the wellbore (302) and injected into one or more fractures to form high thermal conductivity pathways. The slurry pumping system (340) may be configured to also pump another volume of the slurry (345) into the wellbore (302) and an annulus formed by the closed-loop geothermal system (100) and walls of the wellbore (302) or casing string (120). For the purpose of this disclosure, "high" in relation to thermal conductivity may be defined as thermally conductive at least 25 percent (%), 50%, or 75% greater than that of the formation itself.

The emplacement of the slurry (345) may displace at least a portion of the fluid, such as water or frac fluid, already filling a portion of the wellbore (102). This displaced fluid may be allowed to escape through the wellhead via a fluid channel into one or more containers, such as mud-pits.

Initially, fluid pressure propagates and creates induced fractures, e.g., hydraulic fracture (342), the slurry (345) having proppant (351), such as sand, and/or thermally conductive material, may be pumped into natural fractures (305) and/or the induced fractures where the proppant (351) and/or thermally conductive material props open the hydraulic fractures (342) once the fluid pressure is released. The slurry (345) may be pumped into one or more fractures (e.g., the natural fractures (305) and/or the hydraulic fractures (342)) which may at least be partially filled with the slurry (345). Different additives may be used to lower friction pressure, prevent corrosion, etc. The pumping operation may be designed to last a certain length of time to ensure the hydraulic fractures (342) have sufficiently propagated. Further, the slurry (345) may have different make ups throughout the pumping operation to optimize the pumping operation without departing from the scope of the disclosure herein.

In some embodiments, the stimulation system may include an acidizing system (not shown) that may perform an acidizing operation as well as or instead of hydraulic fracturing and propping of the induced fractures, particularly when the rock formation surrounding the wellbores are alkali in nature, such as carbonate and dolomite rocks. In these circumstances an acidic fluid may be pumped into the naturally existing fractures, the pores of the rock (where some background permeability exists) or into the induced fractures. The acidic fluid may dissolve or etch surfaces of the pores, natural or hydraulic fractures, to increase the permeability of the portion of the rock formation lying between the wellbore (302).

When the hydraulic fracturing and/or acidizing operation is completed, the frac tree (308) must be removed from the wellbore (302) to perform the final completion operations which may include drilling out the packers (310*a-c*), and/or plugs (not shown). Subsequently, production tubing (not shown) such as fluid conduit (114) and/or a downhole heat exchanger (not shown) may be installed in the wellbore (302).

In some embodiments, the stimulation system may utilize a slurry mixing system such as slurry mixing system (355). The slurry (345) may be pumped before or after insertion of a closed-loop geothermal system. In some embodiments, the frac blender (338) may be used by the slurry mixing system (355) to mix the slurry (345).

Figure 4:
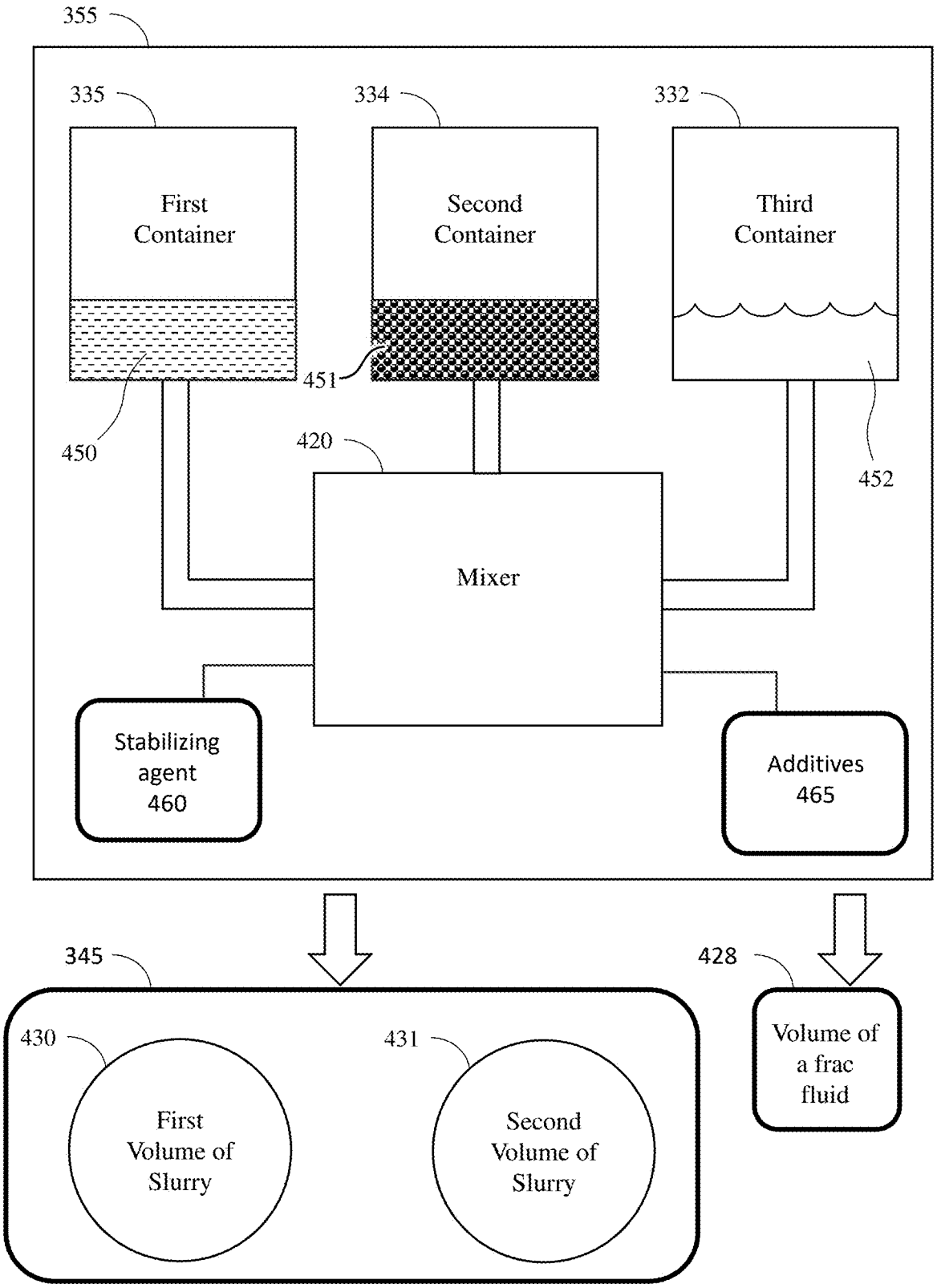
FIG. 4 depicts a slurry mixing system that may be used in various embodiments.

FIG. 4 shows a schematic of the slurry mixing system (355) configured to mix a slurry in accordance with one or more embodiments. The mixing system may include the thermally conductive material storage container (335) having the thermally conductive material (350), the proppant storage container (334) having the proppant (351), and the slurrying agent storage container (332) having the slurrying agent (352). In accordance with one or more embodiments, the thermally conductive material (350) may be mixed with the slurry (345). The slurry (345) may then be injected into either existing natural fractures, surrounding a wellbore such as wellbore (302), or into the hydraulic fractures (342) radiating from the wellbore (302). This injection may be particularly effective at creating the high thermal conductivity pathways (702) through various rocks such as rocks with very low porosity, permeability, and or low moisture content, to allow heat to flow from regions surrounding the wellbore (302) into the wellbore (302).

In some embodiments, a volume of the slurry (345) (e.g., a first volume (430) and/or a second volume (431)) includes a quantity of the thermally conductive material (450), a quantity of the proppant (451), and a quantity of the slurrying agent (452). The quantity of the thermally conductive material (450) is configured to transfer heat. The quantity of the proppant (451) is configured to prop open one or more fractures (605). The quantity of the slurrying agent (452) is configured to suspend the quantity of the thermally conductive material (450) within the quantity of the slurrying agent (452). The slurry (345), or at least a portion of the proppant (451) and the thermally conductive material (450) after the slurry has settled, is configured to preserve permeability within the one or more fractures and facilitate the transfer of heat. The slurry mixing system (355) includes a mixer (420) such as the frac blender (338) and may be configured to mix one or more volumes of the slurry (345), for example, the first volume (430) of the slurry (345) and the second volume (431) of the slurry (345). The second volume (431) of the slurry (345) may include different ratios of the various components relative to the first volume (430) of the slurry (345). For example, the second volume (431) of the slurry (345) may include a higher concentration of the quantity of the thermally conductive material (450) compared to the first volume (430) of the slurry (345). The second volume (431) of the slurry (345) may be configured to have a higher thermal conductivity compared to the first volume (430) of the slurry (345). The mixer (420) may include hardware and/or software for emulsifying, combining, and/or mixing the various slurry components. While FIG. 3 and FIG. 4 may show only one mixing system, it should be obvious to a person having skill in the art that the invention may employ more than one mixing system.

In some embodiments, the slurry (345) may include a stabilizing agent (460) configured to stabilize a suspension of the thermally conductive material (350). A quantity of the stabilizing agent (460) may be mixed in a volume of the slurry (345) using the mixer. Various stabilizing agents may include viscosifiers, friction reducers, and corrosion inhibitors as known to those skilled in the art.

In some embodiments, the slurry (345) may include one or more additives (465) stored in one or more additive storage containers (330). The one or more additives (465) may include friction reducers, biocides, iron chelating agents and viscosifiers. A quantity of the additive (465) may be mixed into a volume of the slurry (345) using the mixer (420). For example, the biocide may be configured to inhibit microbial degradation of the slurry (345) such as any hydrocarbons within the slurry (345). In some embodiments, the biocide may be added into the mixer (420) during the mixing of the slurry. The viscosifier is configured to add viscosity to the slurry (345). The viscosifier may facilitate the transport of the proppant (351) with the slurry (345). The viscosifier may affect fracture geometry. In some embodiments, the viscosifier may be added into the mixer (420) during the mixing of the slurry (345). Viscosifiers may include hydrocarbons in kerosene or gasoline boiling range, biopolymers, aerogels, corrosion inhibitors, and the like. Various viscosifiers are available and known to those skilled in the art.

In some embodiments, the quantity of the slurrying agent (452) may include a quantity of formation brine configured to suspend the quantity of the thermally conductive (450) material within the quantity of formation brine. In some embodiments, the formation brine may be transported from other well sites. In some embodiments, the formation brine may be produced from the wellbore (302).

In some embodiments, the quantity of the slurrying agent (452) may include a quantity of a hydrocarbon blend configured to suspend the quantity of the thermally conductive material (450) within the quantity of the hydrocarbon blend.

In some embodiments, the quantity of the thermally conductive material (450) may include a quantity of graphene, a quantity of graphite, and/or a quantity of fly ash. In some embodiments, the thermally conductive material (350) may include one or more of the above listed materials for mixing into the slurry (345). In some embodiments graphene may be used to form the high thermal conductivity pathways such as high thermal conductivity pathways (702) as described in relation to FIGS. 7A-7C. Graphene has a melting point of approximately 3670 degrees Celsius (degC) and a boiling point of 4,200 degC well above the temperature of commercially utilized thermal heat sources. Graphene also has a thermal conductivity between 1,300 and 5,000 watts per meter per Kelvin (W/mK), depending on the method of measurement and the purity of the graphene, making it superior for this application to copper, which has a thermal conductivity of only 400 W/mK and a melting point around 1085 degC. Graphene in the slurry will typically be nanoparticles, while the other components of the slurry will be particulates in the ranges of 20/40 mesh, 100 mesh, or 200 mesh, for example. Graphene to proppant ratio may be in the range from 1:1 to 10:1 graphene to other particulates, for example.

In some embodiments, the thermally conductive material (350) may include a metal organic heat carrier as an alternative to graphite. Metal-organic heat carriers are typically cage- or open-sphere shaped large organic molecules into which metallic ions are incorporated. Metal-organic heat carriers may be used as heat carriers because of their generally high heat capacity relative to the heat carrying capacity of the formation.

The slurry's liquid phase may include, for example, water as a slurrying agent, a high-temperature friction reducer and a corrosion inhibitor as additives. Concentration ratios may vary, for example, in the range of 100:2:1 to 100:5:2 to 100:7:5 of slurrying agent to friction reducer to corrosion inhibitor.

In some embodiments, the thermally conductive material (350) may include a metal organic heat carrier. The metal organic heat carrier may be in a granular form and configured to be mixed into the slurry (345), injected into one or more fractures, and to transfer heat. The metal organic heat carrier may be formed from any metallic substance such as copper.

In some embodiments, the slurry mixing system (355) may be configured to mix a volume of frac fluid (428) having slurrying agent, proppant, and/or additives. The volume of the frac fluid (428) is configured to stimulate a portion of the subsurface (160) to form one or more induced fractures, e.g., hydraulic fractures, and to prop open the one or more induced fractures.

Figure 5A:
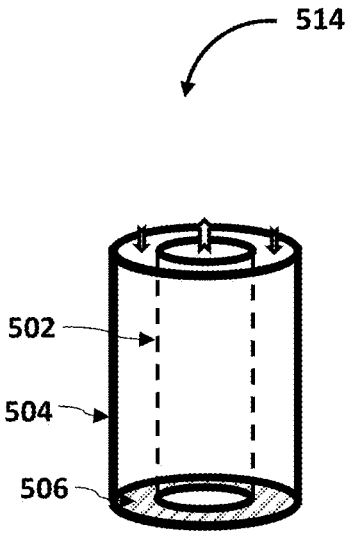
FIG. 5A-D depicts various fluid conduits that may be used in an augmented closed-loop geothermal system in accordance with one or more embodiments.

FIGS. 5A-5D depict examples of bidirectional fluid conduit designs that may be used for the fluid conduits (114) in the closed-loop geothermal system (100) in accordance with one or more embodiments. FIG. 5A shows a first design for a bidirectional fluid conduit (514) that may be used for the fluid conduit (114) as shown in FIG. 1. In FIG. 5A the bidirectional fluid conduit design includes two co-axial pipes with a first pipe (502) disposed within a second pipe (504). In some embodiments, the total cross-sectional area of the second pipe (504) may be essentially double the cross-sectional area of the first pipe (502), so that the cross-sectional area through which fluid can flow in one direction within the first pipe (502) is equal to the cross-sectional area of a conduit annulus (506) through which fluid may flow in the reverse direction. For example, cool working fluid may flow in a first direction (downhole) in the first pipe (502) while hot working fluid may flow in the reverse direction (uphole) through the conduit annulus, or vice versa. The two pipes (502, 504) may form a closed-loop flow path to transport the working fluid between the uphole heat exchanger (108) and the downhole heat exchanger (116).

Figure 5B:
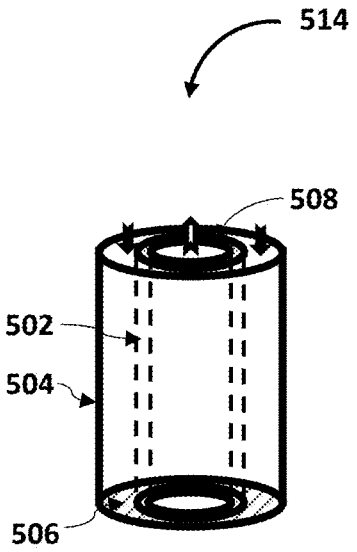

It is essential to thermally isolate the two fluids from one another as much as is practical. Accordingly, as shown in FIG. 5B a thermally insulating layer or insulating annulus (508) may be disposed between the first pipe (502) and the conduit annulus (506). Alternatively, thermal insulation may be created by construction of the first pipe (502) from a material exhibiting low thermal conductivity.

Figure 5C:
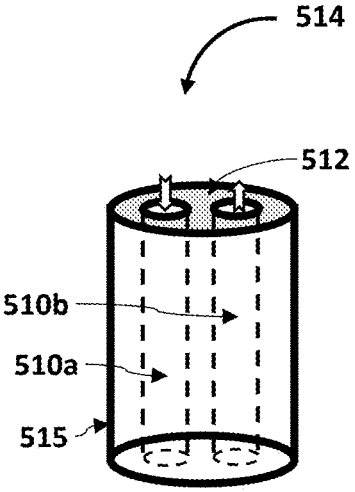
Figure 5D:
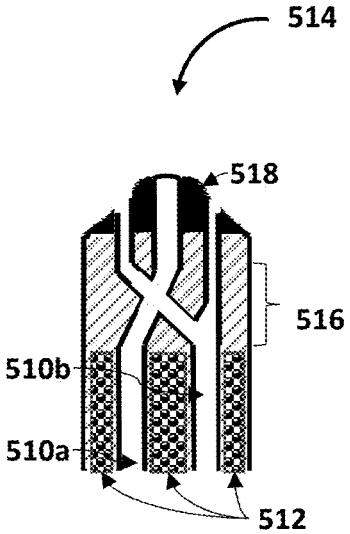

In other embodiments, the bidirectional fluid conduit (514) may include two pipes (510*a*) and (510*b*) of substantially equal cross-sectional areas running substantially parallel to each other side-by-side and embedded within a thermally insulating material (512) that in turn fills an exterior tubular (515), as shown in FIG. 5C. Typically, fluid conduits (114) are manufactured in segments that may be 30-50 feet (ft) in length and such segments are screwed together as they are deployed in a wellbore such as wellbore (302) until they reach the desired length that may be several thousand feet in total. To allow the segments to be screwed together they may include a "male" screw thread (518), as shown in FIG. 5D, at one end and a corresponding "female" socket at the opposing end (not shown). Each segment may also include a cross-over section (516) at each end that transforms a side-by-side design to an annular form to facilitate the connect of the first pipe (510*a*) in a first segment to the first pipe in a second adjacent segment, and the second pipe (510*b*) in the first segment to the second pipe in the second adjacent segment. The two pipes (510*a*, 510*b*) may form a closed-loop flow path to transport the working fluid between the uphole heat exchanger (108) and the downhole heat exchanger (116).

Figure 6:
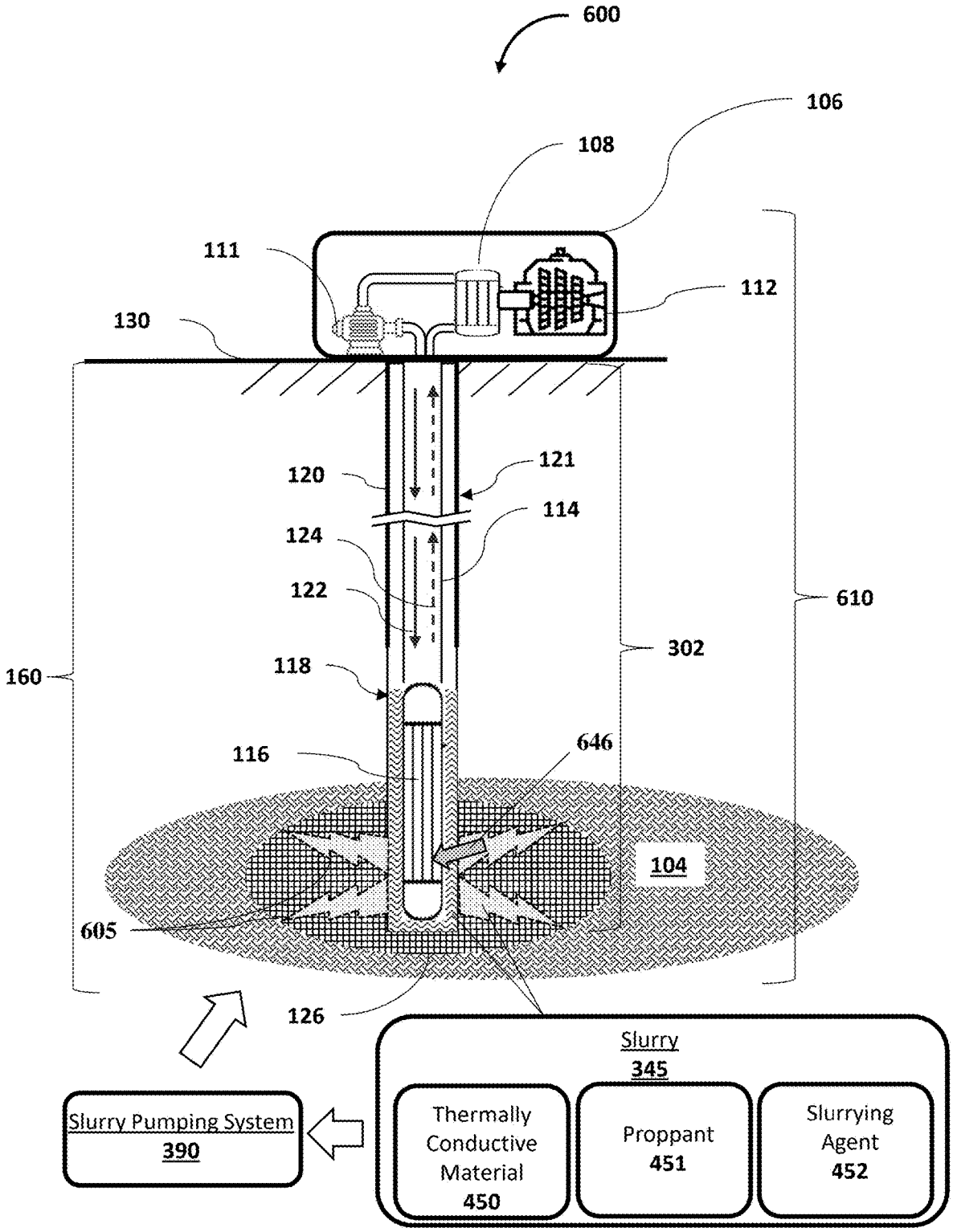
FIG. 6 depicts a heat transfer system in accordance with one or more embodiments.

FIG. 6 depicts a heat transfer system (600) in accordance with one or more embodiments. The heat transfer system (600) includes an augmented closed-loop geothermal system (610) in accordance with one or more embodiments. An augmented closed-loop geothermal system may be constructed with the drilling system, completions system, and stimulation system described in FIGS. 1-4. The augmented closed-loop geothermal system (610) depicted in FIG. 6 shares many components with the closed-loop geothermal system depicted in FIG. 1 and, in the interest of brevity, shared elements are like numbered in FIG. 6 and FIG. 1 and will not be re-described in detail. Instead, attention will be focused on the novel elements of the augmented closed-loop geothermal system (610) shown in FIG. 6.

In some embodiments, the augmented closed-loop geothermal system (610) includes the slurry (345) having the thermally conductive material (350), the proppant (351), and the slurrying agent (352). The slurry (345) may be pumped into a wellbore such as wellbore (302) using the slurry pumping system (390). The slurry (345) may be pumped into the wellbore (302) and into one or more fractures (605) such as fractures (740, 742) described in relation to FIGS. 7A-C. The one or more fractures (605) may be filled, at least partially, with the slurry (345), or may be filled with at least a portion of the quantity of the thermally conductive material (450) following settling of the slurry (345), thereby yielding one or more high thermal conductivity pathways. The one or more fractures (605) may be natural fractures and/or induced fractures such hydraulic fractures stimulated by the hydraulic fracturing system (300). The slurry is configured to facilitate a transfer of heat (646) from the subsurface (160) to the downhole heat exchanger (116).

In some embodiments, the first volume (430) of the slurry (345) may be injected into the one or more fractures (605) to form high thermal conductivity pathways. The first volume may be configured to transfer heat from the subsurface to the high thermal conductivity pathways. In some embodiments, the second volume (431) of the slurry (345) may be pumped into wellbore (302) which may fill an annulus of the wellbore (302) formed by the downhole heat exchanger (116) and walls of the wellbore (302) and/or the casing string (120). In some embodiments, the second volume of the slurry (345) may be pumped into the wellbore (302) first and then displaced by the downhole heat exchanger (116) as the downhole heat exchanger is disposed in the wellbore (302).

Figure 7A:
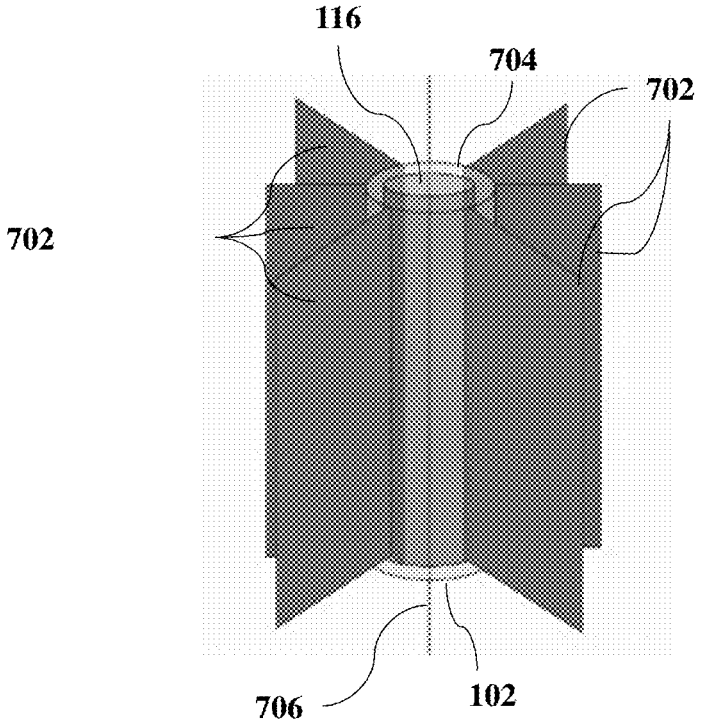
FIG. 7A-C depicts a region of a subsurface having one or more fractures that may be utilized by a heat transfer system in accordance with one or more embodiments.
Figure 7B:
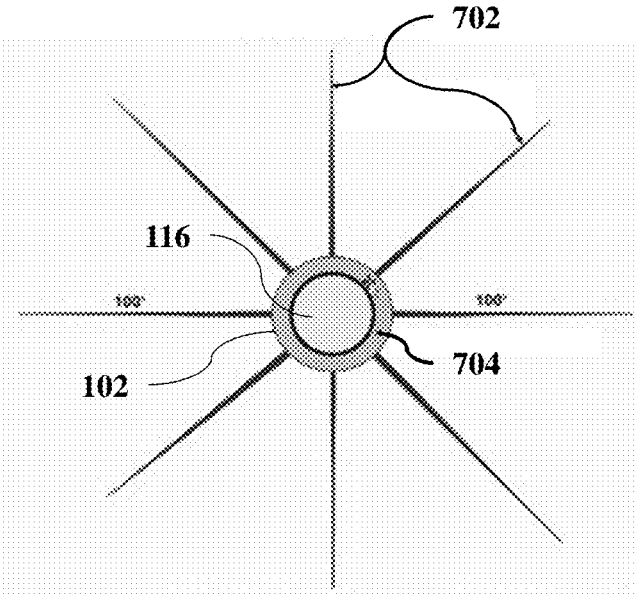

FIGS. 7A and 7B show idealized elements of the heat transfer system (600) including a network of high thermal conductivity pathways (702) (i.e., fractures (605) filled with the slurry (345) having the thermally conductive material (350)) and an annulus (704) filled with the slurry (345) having the thermally conductive material (350), or may be filled with at least a portion of the quantity of the thermally conductive material (450) following settling of the slurry (345), in accordance with one or more embodiments. Specifically, FIG. 7A shows a three-dimensional perspective view of the downhole heat exchanger (116) disposed inside the wellbore (302) at a depth where the wellbore (302) having a wellbore axis (706), for example, may be within the geothermal heat source (104). The annulus (704) is formed between the augmented closed-loop geothermal system (610) (e.g., the downhole heat exchanger (116)) and the wall of the wellbore (302). The annulus (704) may be filled with a volume of the slurry (345) (e.g., the second volume (431)), or may be filled with at least a portion of the quantity of thermally conductive material following settling of the slurry. The volume of the slurry (345) that fills the annulus (704) may have different concentrations of the various slurry components than a volume of the slurry (345) that fills the one or more fractures (605). Radiating out away from the wellbore (302) are six idealized fractures filled with the slurry (345) having the thermally conductive material (350) to form high thermal conductivity pathways (702).

In some embodiments, the downhole heat exchanger (116), the annulus (704) filled with a volume of the slurry (345) having the quantity of the thermally conductive material (450), or may be filled with at least a portion of the quantity of the thermally conductive material (450) following settling of the slurry (345), and high thermal conductivity pathways (702) may share the same vertical extent along the wellbore (302), while in other embodiments the downhole heat exchanger (116), the annulus (704) filled with a volume of the slurry (345), or may be filled with at least a portion of the quantity of the thermally conductive material (450) following settling of the slurry (345), and high thermal conductivity pathways (702) may each have different extents along the wellbore (302). In some embodiments, the downhole heat exchanger (116), the annulus (704) filled with a volume of the slurry (345), or may be filled with at least with a portion of the quantity of the thermally conductive material (450) following settling of the slurry (345), and high thermal conductivity pathways (702) may all extend across the full depth range of the geothermal heat source (104) penetrated by the wellbore (302), while in other embodiments they may have a greater or a lesser extent than the full depth range of the geothermal heat source (104) penetrated by the wellbore (302). The extent of the high thermal conductivity pathways (702) in the radial direction away from the wellbore (302) may vary from one embodiment to another, nor need each high thermal conductivity have the same radial extent as the others. However, in typical embodiments, the high thermal conductivity pathways (702) may extend approximately 100 ft away from the wellbore (302) in an approximately radial direction.

Figure 7C:
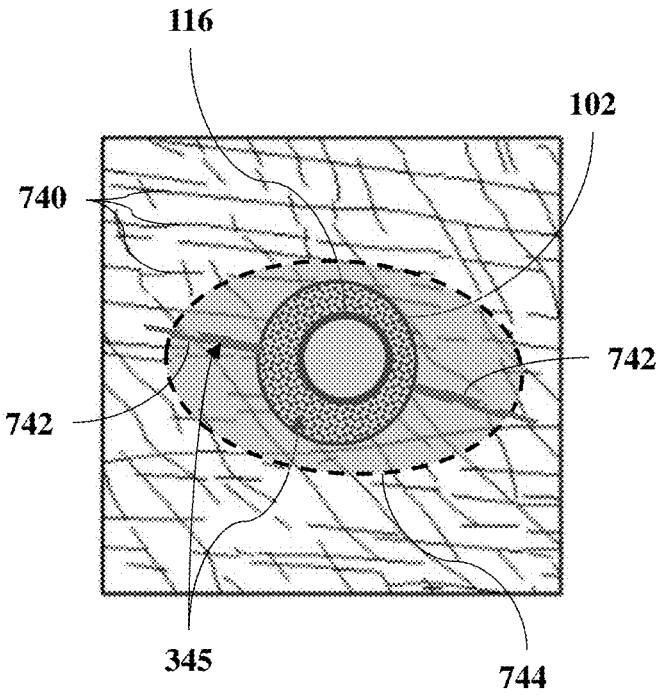

FIG. 7B depicts the idealized elements of the heat transfer system (600) in cross-section normal to the wellbore axis (706), i.e., in map view. Although the downhole heat exchanger (116) is shown as centered in the wellbore (302), a volume of the slurry (345), or may be filled with at least a portion of the quantity of the thermally conductive material (450) following settling of the slurry (345), filling a symmetrical annulus between the downhole heat exchanger (116) and the wall of the wellbore (302), and the high thermal conductivity pathways (702) as evenly spaced, this is unlikely to be the case in practice and should not be interpreted as limiting the scope of the invention. FIG. 7C shows a cross-section through a more realistic embodiment. A wellbore such as the wellbore (302) penetrates a geothermal heat source containing a network of natural fractures (740). The network of natural fractures (740) contains a plurality of fractures that may have orientations that are not isotropic, i.e., the natural fractures may have one or more preferred orientations, influenced by current and past stress fields. In addition, in accordance with one or more embodiments, induced fractures, such as induced fractures (742), may emanate from the wellbore (302) in one or more preferred direction. The downhole heat exchanger (116) may be disposed in an off-centered manner, displaced from the axis of the wellbore (302). In some embodiments, the one or more fractures (605) may be fully or partially filled with the slurry (345) having the high thermal conductivity material, or may be filled with at least a portion of the quantity of the thermally conductive material (450) following settling of the slurry (345), to form the high thermal conductivity pathways (702). In some embodiments, the fractures (605) within a portion (744) of the network of natural fractures (740) surrounding the wellbore (302) may be fully or partially impregnated by a volume of the slurry (345) having the high thermal conductivity material. The portion (744) may be circular or elliptical (as shown) in cross-section, but in general may have an irregular shape influenced by the fluid conductivity of the network of the fractures (605). The shape of the portion (744) should not be interpreted as limiting the scope of the invention.

Figure 8:
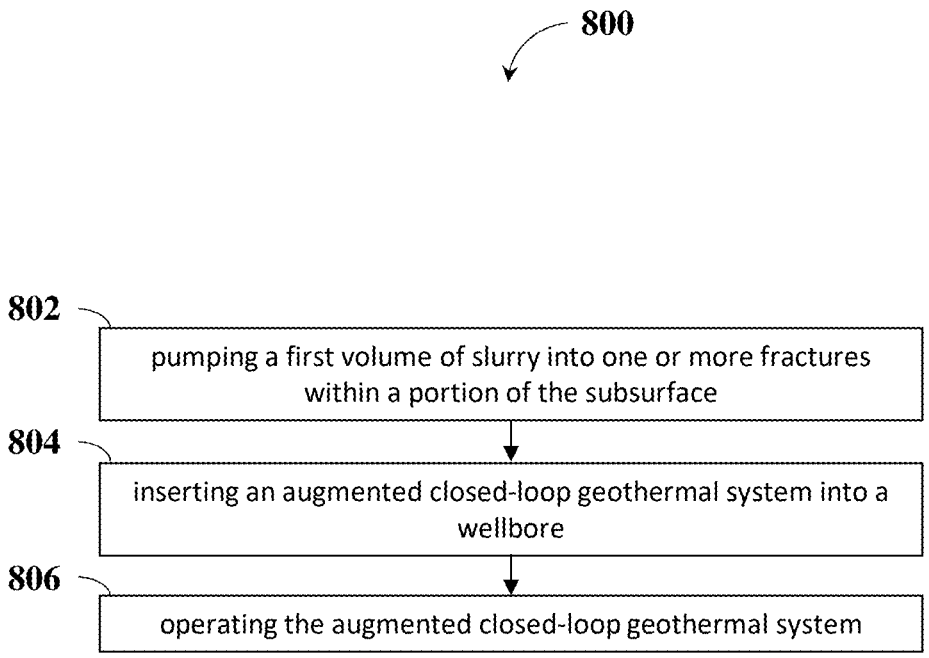
FIG. 8 depicts a flowchart for transferring heat using a heat transfer system in accordance with one or more embodiments.

FIG. 8 depicts a flowchart in accordance with one or more embodiments describing a method for constructing and/or operating an augmented geothermal system for heat transfer between a subsurface having natural fractures and a downhole heat exchanger inserted in a wellbore (hereafter "heat transfer method") (800). In some embodiments, the heat transfer method (800) may use the heat transfer system (600). Although the steps in flowchart using the heat transfer method are shown in sequential order, it will be apparent to one of ordinary skill in the art that some steps may be conducted in parallel, in a different order than shown, or may be omitted without departing form the scope of the invention.

In box (802), the heat transfer method (800) includes pumping, using the slurry pumping system (340), the first volume (430) of the slurry (345) into the one or more fractures (605) within a portion of the subsurface (160) in accordance with one or more embodiments. The one or more fractures (605) may be the network of natural fractures (740) and/or induced fractures (742). In some embodiments, pumping the first volume (430) of the slurry (345) may include using a pump-hold-relax technique. The pump-hold-relax technique may include pumping to a predetermined high threshold, holding until the pressure has stabilized, relaxing the pressure to a predetermined low threshold, and then repeating until an overall pressure has stabilized and the volume of the slurry has reached a predetermined input threshold or a predetermined minimum rate threshold has been reached.

An example of the procedure employed in the pump-hold-relax technique is below. Based on the disclosure herein, one of ordinary skill in the art will recognize variations in this technique that may be used in relation to different embodiments. The pump-hold-relax technique may include (i) pumping at a desired rate until breakdown pressure is achieved, for example, in the range of 10 to 80 barrels/minute (bpm). The technique may include using fluid having water and high temperature friction reducer for pumping. The technique may include (ii) adding the slurry with proppant and increase the pump rate. For example, (ii)(a) pumping at 20 bpm with the water and high temperature friction reducer. After the pressure breakdown, the technique may include (ii)(b) increasing pump rate to 30-60 bpm for a pre-determined time period. The technique may include (ii)(c) a pause in pumping for another pre-determined time period and letting the formation rock relax and fill with slurry. The technique may include (iii) restarting the pumping at an increased rate (30-80 bpm, for example), for extending or perpetuating new fractures and exceeding initial breakdown pressure. The technique may include repeating (ii)(c) and (iii) until an acceptable continuous feed rate is achieved. This may occur after 1-2 repetitions, or it may take many more, depending on the characteristics of the geological formation where stimulation is taking place.

In box (804), the heat transfer method (800) includes inserting a closed-loop geothermal system into the wellbore (302) to form the augmented closed-loop geothermal system (610) with the slurry (345) and the high thermal conductivity pathways in accordance with one or more embodiments. The closed-loop geothermal system includes a fluid conduit (114), and the downhole heat exchanger (116) fluidly connected to the fluid conduit. The fluid conduit (114) includes the closed-loop flow path and is configured to transport the working fluid between the uphole heat exchanger (108) and the downhole heat exchanger (116).

In box (806), the heat transfer method (800) includes operating the augmented closed-loop geothermal system (610) in accordance with one or more embodiments. Operating the augmented closed-loop geothermal system (610) may include receiving the cool working fluid (122) flowing in the first direction by the downhole heat exchanger (116) disposed within a portion of the wellbore (302) penetrating the geothermal heat source (104). Operating the augmented closed-loop geothermal system (610) may include forming, by heating with the downhole heat exchanger (116), the hot working fluid (124) from the cool working fluid (122). In some embodiments, the downhole heat exchanger (116) transfers heat from the geothermal heat source (104) to the cool working fluid (122). The slurry (345) or at least a portion of the quantity of the thermally conductive material (450) following settling of the slurry (345), filling at least a portion of the one or more fractures (605) (e.g., natural fractures (305)) and/or the annulus (704), is configured to facilitate the transfer of heat from the geothermal heat source (104) to the downhole heat exchanger (116) and in turn to the cool working fluid (122). Operating the augmented closed-loop geothermal system (610) may include channeling the hot working fluid (124) in a second direction through the fluid conduit (114) (e.g., the bidirectional fluid conduit (514)) to the uphole heat exchanger (108) disposed in the heat utilization facility (106). Operating the augmented closed-loop geothermal system (610) may include forming, by cooling with the uphole heat exchanger (108), the cool working fluid (122) by extracting heat from the hot working fluid (124).

Figure 9:
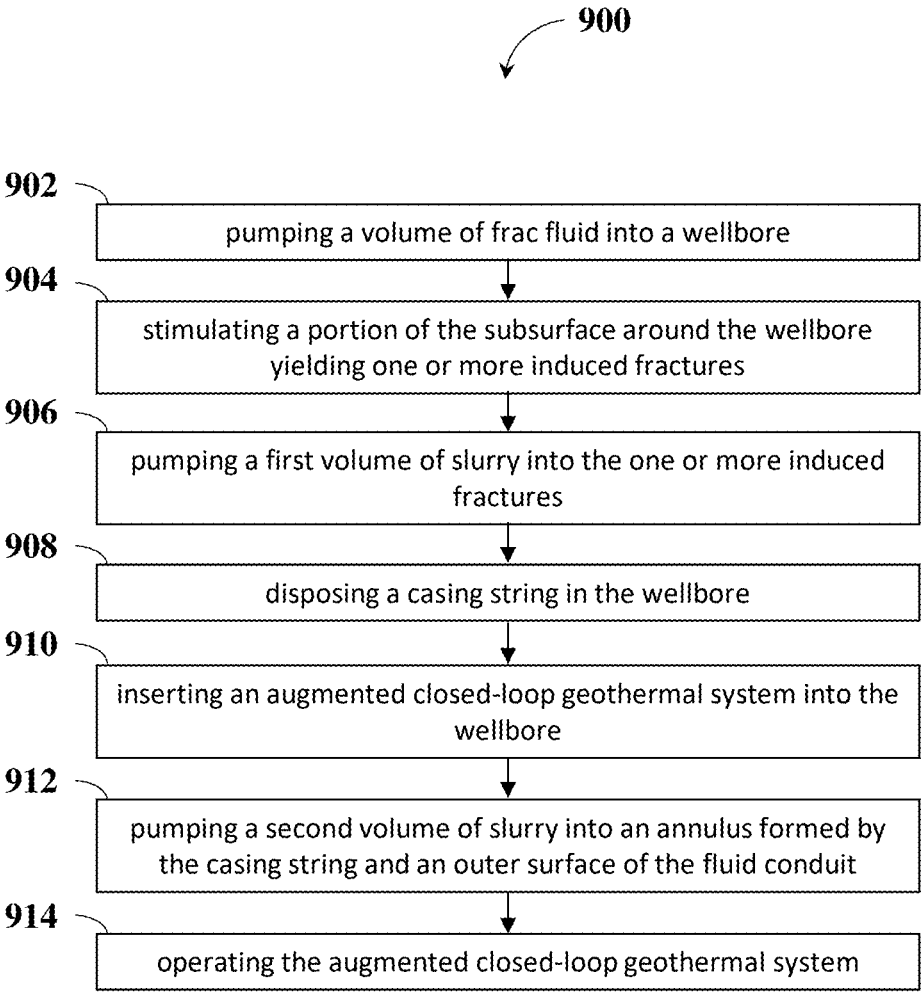
FIG. 9 depicts a flowchart for transferring heat using a heat transfer in accordance with one or more embodiments.

FIG. 9 depicts a flowchart describing a heat transfer method (900) having at least the induced fractures (742) in accordance with one or more embodiments. In some embodiments, the heat transfer method (900) may use the heat transfer system (600). Although the steps in flowchart using the heat transfer method are shown in sequential order, it will be apparent to one of ordinary skill in the art that some steps may be conducted in parallel, in a different order than shown, or may be omitted without departing form the scope of the invention.

In box (902), the heat transfer method (900) includes pumping, using the stimulation system such as the hydraulic fracturing system (300), a volume of the slurry (345) into the wellbore (302) in accordance with one or more embodiments. In some embodiments, stimulating the portion of the subsurface (160) includes hydraulic fracturing using the hydraulic fracturing system (300). The wellbore (302) may be an existing wellbore or a newly drilled wellbore. A wellbore such as the wellbore (302) may be substantially vertical or may be deviated and may include substantially horizontal sections.

In box (904), the heat transfer method (900) includes stimulating a portion of the subsurface (160) around the wellbore (302) yielding the one or more induced fractures (742) in accordance with one or more embodiments. In some embodiments, stimulating the portion of the subsurface (160) comprises utilizing a pulse energetics technique. In some embodiments, stimulating the portion of the subsurface (160) includes utilizing water-free stimulation as variations from the pump-hold-relax technique described above.

In box (906), the heat transfer method (900) includes pumping, using the slurry pumping system (340), the first volume (430) of the slurry (345) into the one or more fractures (605) within a portion of the subsurface (160) in accordance with one or more embodiments. The one or more fractures (605) may be the induced fractures (342, 742) and/or the natural fractures (305, 740). In some embodiments, pumping the first volume (430) of the slurry (345) may include using a pump-hold-relax technique.

In box (908), the heat transfer method (900) includes disposing a casing string in a wellbore in accordance with one or more embodiments. In some embodiments, the casing string (120) may be inserted using the completions system (190) having a drilling rig configured to insert the casing string (120). In some embodiments, the casing string (120) may be inserted using the completions system (190) having the specialized tubular insertion rig configured to handle casing strings and tubulars such as fluid conduits with greater precision and gentler handling so as not to damage any outer surface of the casing string (120) and to avoid improper connections of each section of the casing string (120).

In box (910), the heat transfer method (900) includes inserting the augmented closed-loop geothermal system having the fluid conduit (114) and the downhole heat exchanger (116) fluidly connected to the fluid conduit (114) into the wellbore (302) in accordance with one or more embodiments. In some embodiments, the downhole heat exchanger (116) is operatively connected to the heat utilization facility (106). In some embodiments, the fluid conduit (114) may be inserted using a drilling rig. In some embodiments, the fluid conduit (114) may be inserted using a specialized tubular insertion rig configured to handle casing and tubular such as fluid conduits with greater precision and gentler handling compared to typical rigs so as not to damage any outer surface of the fluid conduit (114) and to avoid improper connections of each section of the fluid conduit (114).

In box (912), the heat transfer method (900) includes pumping, using the slurry pumping system (340), the second volume (431) of the slurry (345) into the annulus (704) formed by the casing string (120) and the augmented closed-loop geothermal system (610) in accordance with one or more embodiments. In some embodiments, the second volume (431) of the slurry (345) may include different ratios of components, for example, the concentration of the thermally conductive material (350) may be higher relative to the first volume (430) of the slurry (345).

In box (914), the heat transfer method (900) may include operating the augmented closed-loop geothermal system (610) in accordance with one or more embodiments. Operating the augmented closed-loop geothermal system (610) may include receiving the cool working fluid (122) flowing in the first direction by the downhole heat exchanger (116) disposed within a portion of the wellbore (302) penetrating the geothermal heat source (104). Operating the augmented closed-loop geothermal system (610) may include forming, by heating with the downhole heat exchanger (116), the hot working fluid (124) from the cool working fluid (122). In some embodiments, the downhole heat exchanger (116) transfers heat from the geothermal heat source (104) to the cool working fluid (122). The slurry (345) or at least a portion of the quantity of the thermally conductive material (450) following settling of the slurry (345), filling at least a portion of the induced fractures (742) and/or the annulus (704), is configured to facilitate the transfer of heat from the geothermal heat source (104) to the downhole heat exchanger (116) and in turn to the cool working fluid (122). Operating the augmented closed-loop geothermal system (610) may include channeling the hot working fluid (124) in a second direction through the bidirectional fluid conduit (514) to the uphole heat exchanger (108) disposed in the heat utilization facility (106). Operating the augmented closed-loop geothermal system (610) may include forming, by cooling with the uphole heat exchanger (108), the cool working fluid (122) by extracting heat from the hot working fluid (124).

Embodiments of the present disclosure may provide at least one of the following advantages. Slurry as disclosed herein provides an improved high thermal conductivity pathway to facilitate heat transfer from the subsurface to the augmented closed-loop geothermal system. The improved high thermal conductivity pathway provides an efficient heat transfer thereby maintaining sufficient heat to the augmented closed-loop geothermal system which improves the performance and the cost effectiveness of this renewable energy source.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. A slurry for heat transfer between a subsurface and a downhole heat exchanger inserted in a wellbore, the slurry comprising:
- a quantity of a material having a high thermal conductivity configured to transfer heat;
- a quantity of a proppant configured to prop open one or more fractures; and
- a quantity of a slurrying agent configured to suspend the quantity of the thermally conductive material within the quantity of the slurrying agent,
  - wherein the slurry is configured to:
    - be pumped into the wellbore using a pump-hold-relax technique until volume and pressure stabilize within the wellbore;
    - preserve permeability within one or more fractures; and
    - facilitate a transfer of heat to the downhole heat exchanger.

2. The slurry according to claim 1, further comprising a quantity of stabilizing agent configured to stabilize a suspension of the thermally conductive material.

3. The slurry according to claim 1, wherein the quantity of the thermally conductive material comprises a quantity of graphene.

4. The slurry according to claim 3, wherein the quantity of the thermally conductive material further comprising a quantity of graphite and a quantity of fly ash.

5. The slurry according to claim 1, wherein the quantity of the slurrying agent comprises a quantity of formation brine configured to suspend the quantity of the thermally conductive material within the quantity of formation brine.

6. The slurry according to claim 1, wherein the quantity of the slurrying agent comprises a quantity of hydrocarbon blend configured to suspend the quantity of the thermally conductive material within the quantity of hydrocarbon blend.

7. A method for heat transfer between a subsurface and a downhole heat exchanger inserted in a wellbore, the method comprising:
- pumping a first volume of a slurry into the wellbore and into one or more fractures:
  - wherein pumping the first volume of the slurry comprises using a pump-hold-relax technique until volume and pressure stabilize within the wellbore, and
  - wherein the first volume of the slurry comprises:
    - a quantity of a quantity of a material having a high thermal conductivity configured to transfer heat,
    - a quantity of a proppant configured to prop open one or more fractures, and
    - a quantity of a slurrying agent configured to suspend the quantity of the thermally conductive material within the quantity of the slurrying agent,
    - wherein the first volume of the slurry is configured to:
    - preserve permeability within the one or more fractures; and
    - facilitate a transfer of heat; and
- inserting a closed-loop geothermal system into the wellbore to from an augmented closed-loop geothermal system,
  - wherein the augmented closed-loop geothermal system comprises a fluid conduit and the downhole heat exchanger fluidly connected to the fluid conduit.

8. The method according to claim 7, further comprising operating the augmented closed-loop geothermal system.

9. The method according to claim 7, further comprising:
- disposing a casing string in the wellbore; and
- pumping a second volume of slurry into an annulus formed by the casing string and the closed-loop geothermal system.

10. The method according to claim 7, wherein the first volume of the slurry comprises a chelating agent.

11. The method according to claim 7, further comprising:
- pumping, using a stimulation system, a volume of a frac fluid into the wellbore; and
- stimulating a portion of the subsurface around the wellbore yielding one or more induced fractures,
  - wherein stimulating the portion of the subsurface comprises hydraulic fracturing using a hydraulic fracturing system.

12. The method according to claim 7,
- pumping, using a stimulation system, a volume of a frac fluid into the wellbore; and
- stimulating a portion of the subsurface around the wellbore yielding one or more induced fractures,
  - wherein stimulating the portion of the subsurface comprises utilizing a pulse energetics technique.

13. The method according to claim 7, pumping, using a stimulation system, a volume of a frac fluid into the wellbore; and
- stimulating a portion of the subsurface around the wellbore yielding one or more induced fractures,
  - wherein stimulating the portion of the subsurface comprises utilizing pulse energetics stimulation.

14. The method according to claim 7, wherein the quantity of the thermally conductive material comprises a quantity of graphene.

15. The method according to claim 7, wherein the quantity of slurrying agent comprises a quantity of formation brine configured to suspend the thermally conductive material within the quantity of formation brine.

16. A system of increasing heat transfer between a downhole heat exchanger and a subsurface, the system comprising:
- a wellbore extending from a surface and penetrating the subsurface;
- a slurry pumping system configured to pump a first volume of slurry into one or more fractures, wherein the first volume of slurry comprises:

a quantity of a quantity of a material having a high thermal conductivity configured to transfer heat;

a quantity of a proppant configured to prop open the one or more fractures; and a quantity of a slurrying agent configured to suspend the quantity of the thermally conductive material within the quantity of the slurrying agent, wherein the first volume of the slurry is configured to:

be pumped into the wellbore using a pump-hold-relax technique until volume and pressure stabilize within the wellbore, preserve permeability within the one or more fractures, and facilitate a transfer of heat;

a closed-loop geothermal system configured to transfer heat from the downhole heat exchanger to an uphole heat exchanger, the closed-loop geothermal system comprising:

a working fluid configured to transfer heat, the uphole heat exchanger configured to transfer heat from the working fluid, the downhole heat exchanger disposed within the wellbore and configured to transfer heat to the working fluid, and a fluid conduit fluidly connected to the uphole heat exchanger and the downhole heat exchanger, wherein the fluid conduit comprises a closed-loop flow path and configured to transport the working fluid between the uphole heat exchanger and the downhole heat exchanger; and a completions system configured to insert the downhole heat exchanger and the fluid conduit into the wellbore to form an augmented closed-loop geothermal system with the slurry.

17. The system according to claim 16, wherein the completions system is further configured to dispose a casing string in the wellbore, wherein the slurry pumping system is configured to pump a second volume of slurry into an annulus formed by the casing string and the augmented closed-loop geothermal system.

18. The system according to claim 16, further comprising a heat utilization facility configured to operate the downhole heat exchanger.

19. The system according to claim 16, further comprising a stimulation system configured to stimulate a portion of the subsurface around the wellbore yielding one or more induced fractures.

20. The system according to claim 16, wherein the completions system comprises a specialized tubing insertion rig.

21. A system of increasing heat transfer between a subsurface and a downhole heat exchanger during operation, the system comprising:

a wellbore extending from a surface and penetrating the subsurface;

a closed-loop geothermal system configured to transfer heat from the downhole heat exchanger to an uphole heat exchanger, the closed-loop geothermal system comprising:

a working fluid configured to transfer heat, the uphole heat exchanger configured to transfer heat from the working fluid, the downhole heat exchanger disposed within the wellbore and configured to transfer heat to the working fluid, and a fluid conduit fluidly connected to the uphole heat exchanger and the downhole heat exchanger, wherein the fluid conduit comprises a closed-loop flow path and configured to transport the working fluid between the uphole heat exchanger and the downhole heat exchanger;

one or more fractures within the subsurface and filled, at least partially, with a proppant and a quantity of a material having a high thermal conductivity sufficient to form a thermally conductive pathway configured to transfer heat from the subsurface to the downhole heat exchanger forming an augmented closed-loop geothermal system, wherein the one or more fractures were created using a pump-hold-relax technique until volume and pressure stabilize within the wellbore; and a heat utilization facility configured to operate the downhole heat exchanger and comprising:

an uphole heat exchanger configured to extract heat energy from a hot working fluid; and a turbine operatively connected to the fluid conduit and configured to generate electrical power, wherein the turbine is operatively connected to the uphole heat exchanger.

22. The system of claim 21, further comprising:

a casing string disposed in the wellbore; and a second volume of slurry disposed in an annulus formed by the casing string and the augmented closed-loop geothermal system.

* * * * *